US008141254B2

(12) United States Patent
Shimizu

(10) Patent No.: US 8,141,254 B2
(45) Date of Patent: Mar. 27, 2012

(54) RECIPROCATING TYPE ELECTRIC SHAVER

(75) Inventor: Tetsuhiko Shimizu, Matsumoto (JP)

(73) Assignee: Izumi Products Company, Nagano (JP)

( * ) Notice: Subject to any disclaimer, the term of this patent is extended or adjusted under 35 U.S.C. 154(b) by 120 days.

(21) Appl. No.: 11/375,868

(22) Filed: Mar. 15, 2006

(65) Prior Publication Data

US 2006/0207100 A1 Sep. 21, 2006

(30) Foreign Application Priority Data

Mar. 18, 2005 (JP) ..... 2005-078963

(51) Int. Cl.
*B26B 19/20* (2006.01)

(52) U.S. Cl. ..... 30/43; 30/43.91; 30/43.92

(58) Field of Classification Search ..... 30/43.92, 30/43.91, 43, 43.1, 346.51
See application file for complete search history.

(56) References Cited

U.S. PATENT DOCUMENTS 2,105,775 A * 1/1938 Nilson ..... 30/43.92
2,198,118 A * 4/1940 Knapp ..... 30/43.92
2,205,905 A * 6/1940 Muros ..... 30/43
2,245,795 A * 6/1941 Landgraf ..... 30/43.92
2,256,076 A * 9/1941 Coles ..... 30/34.05
2,298,962 A * 10/1942 Murphy ..... 30/43.92
2,370,544 A * 2/1945 Jepson et al. ..... 30/34.1
2,371,242 A * 3/1945 Jensen ..... 30/34.1
2,461,858 A * 2/1949 Towers ..... 30/43.1
5,669,138 A * 9/1997 Wetzel ..... 30/43.92
5,802,721 A * 9/1998 Wain et al. ..... 30/34.2
6,082,004 A * 7/2000 Hotani ..... 30/43.92
6,966,116 B2 * 11/2005 Peter et al. ..... 30/346.51

FOREIGN PATENT DOCUMENTS

JP 2000-084270 3/2000

* cited by examiner

*Primary Examiner* — Boyer D Ashley
*Assistant Examiner* — Omar Flores-Sánchez
(74) *Attorney, Agent, or Firm* — DLA Piper LLP (US)

(57) ABSTRACT

A reciprocating type electric shaver having a trimmer blade, which is substantially reverse L-shaped in cross section and installed in a shaver head of a shaver main body, wherein the trimmer blade comprises a stationary outer cutter that is bent in substantially a reverse L shape and a movable inner cutter that makes sliding contact with the inner surface of the stationary outer cutter; and in the horizontal bent part at the upper end of the outer cutter is formed with first slits that open toward the open end side and second slits that open toward the opposite bent corner side of the horizontal bent part; so that the outer cutter works together with the reciprocating inner cutter to cut the hair that enters the slits.

4 Claims, 9 Drawing Sheets

RECIPROCATING TYPE ELECTRIC SHAVER

BACKGROUND OF THE INVENTION

1. Field of the Invention

The present invention relates to a reciprocating type electric shaver provided with a trimmer blade that is substantially reverse L-shaped in cross section.

2. Description of the Related Art

A typical reciprocating type electric shaver includes a finishing blade that cuts by causing its movable inner cutter to make sliding contact with the inner surface of its stationary or immovable outer cutter that is curved in an arch shape; and hair, for instance, whiskers, that enters hair introduction holes of the outer cutter is cut by the reciprocating inner cutter.

Reciprocating type electric shavers that have trimmer blades in addition to the above-described finishing blade are also known.

The finishing blade has hair introduction holes in a form of a plurality of small holes in the outer cutter. Accordingly, the problem is that though relatively straight hair can enter into the hair introduction holes easily and is cut, curved unruly hair has difficulty to go into the hair introduction holes.

On the other hand, the trimmer blade is to introduce unruly hair thereinto and cut it smoothly. Accordingly, the hair introduction holes of the outer cutter of the trimmer blade are typically in a slit shape.

More specifically, the trimmer blade is in a shape of a reversed L shape (or the cross section is substantially a reverse L shape), and the outer cutter thereof has a horizontal bent part in which slits are formed so that they open toward the open end side of the horizontal bent part, and the comb-shaped portion remaining between the slits scrapes up the hair and guides it into the slits for cutting. Thus, the trimmer blade can cut curved unruly hair easily and well.

Japanese Patent Application Laid-Open (Kokai) No. 2000-84270 shows a reciprocating type electric shaver that includes an arch-shaped finishing blade (indicated by reference numeral 5 in FIG. 1 of this related art), a rectangular coarse shaving slit blade (reference numeral 6 in FIG. 1 of this related art), and a trimmer blade that is reverse L-shaped in cross section (reference numeral 7 in FIG. 1 of this related art); and these blades are provided in parallel.

In the trimmer blade (7) of this related art, hair enters the slits (slit blade 75) that open on the leading end (open end) side of the outer cutter (upper stationary outer cutter 71, see FIGS. 6-9 of this related) and is cut by the inner cutter (lower moving cutter 72). This related art further shows a slit holes (76) that projects upward in the bent part of the outer cutter; however, this slit holes (76) are those that scrape up curved hair guided to the adjacent finishing blade (5), and it is not a cutter for cutting hair (see paragraphs 0021 and 0022 of this related art).

FIG. 6 shows another type of one of known reciprocating type electric shavers. FIG. 7 shows the trimmer blade of this shaver, and FIG. 8 is a disassembled perspective view thereof. Also, FIGS. 9A through 9C show the stationary outer cutter of the trimmer blade.

In FIG. 6, the reference numeral 10 is a shaver main body, and a shaver head 12 is detachably attached to the upper part of the shaver main body 10. The shaver main body 10 includes an electric motor and a rechargeable battery (both not shown in the drawings). A pair of finishing blades 14 are provided in parallel in the shaver head 12, with a trimmer blade 16 in between.

Each of the finishing blades 14 has a stationary outer cutter comprising a thin metal plate that is curved in an arch shape and a movable inner cutter (not shown in the drawings) that makes reciprocating motion inside the stationary outer cutter. A plurality of small holes (hair introduction holes) open in the outer cutter. The inner cutter has a plurality of arch-shaped cutter blades aligned orthogonal to the reciprocating direction or in the lengthwise direction, and hair that enters the small holes of the outer cutter is cut by the reciprocating inner cutter.

The trimmer blade 16 is a combination of, as seen from FIG. 8, a stationary or immovable outer cutter 18 (called "outer cutter"), which is substantially reverse L-shaped in cross section, and a movable inner cutter 20 (called "inner cutter"), which makes reciprocating motion inside or underneath the stationary outer cutter 18. The outer cutter 18 has a flat standing wall part 22 and a horizontal bent part 24 that is horizontally bent at the upper end of the flat standing wall part 22. Formed in the horizontal bent part 24 of the inner cutter 20 are a plurality of slits 28 that open toward its open end 26 side. As is clear from FIG. 9A, these slits 28 are closed on the side opposite from the open end 26; in other words, the slits 28 are closed on the bent corner 30 side (which is on the right side of the horizontal bent part 24 in FIGS. 9A and 9C). These slits 28 are orthogonal to the longitudinal direction of the standing wall part 22, that is, orthogonal to the reciprocating direction (shown by arrow R in FIG. 8) of the inner cutter 20.

As seen from FIG. 9C, the inner cutter 20 is substantially a reverse L shape, and it includes a support part 32 that extends downward and a horizontal bent part 34 that is horizontally bent at the upper end of the support part 32. Formed in the horizontal bent part 34 are a plurality of slits 36 that open toward its open end side or left side in FIG. 9C. Accordingly, the horizontal bent part 24 of the outer cutter 18 and the horizontal bent part 34 of the inner cutter 20 have a substantially comb shape due to the portions remaining between the slits 28 and 36. As shown in FIG. 9C, the open end 26 of the horizontal bent part 24 of the outer cutter 18 bends slightly downward in a substantially hook shape, so that the downwardly bent portion conceals the open end of the horizontal bent part 34 of the inner cutter 20.

The outer cutter 20 and the inner cutter 18 are combined and integrated as shown in FIG. 7. As seen from FIG. 8, a sliding plate 38 is fixed to the support part 32 of the inner cutter 20, and a pair of flat springs 40 that extend in a wing-form are fixed to both side edges of the sliding plate 38. The outer cutter 18 is inserted into and held by a pair of resin end members 42 at both ends.

The inner cutter 20 is provided inside the outer cutter 18; and when the inner cutter 20 is thus installed inside the outer cutter 18, the tip ends of the flat springs 40 held on the sliding plate 38 touch from above the horizontal surfaces 44 of the end members 42 that hold the outer cutter 18. Accordingly, the inner cutter 20 is pushed upward by the flat springs 40 and is elastically compressed at the outer cutter 18 from below. Under this state, a presser plate 46 is attached to the end member 42 from the side opposite the standing wall part 22 of the outer cutter 18. The presser plate 46 is fixed to the end members 42 by pressing a left/right pair of catches 48 into engagement openings 50 in the end member 42.

Because of the structure described above, the inner cutter 20 and sliding plate 38 are sandwiched between the standing wall part 22 of the outer cutter 18 and the presser plate 46 and held so that they can reciprocate freely sideways. The inner cutter 20 is pushed upward by the flat springs 40, and the upper surface of the horizontal bent part 34 of the inner cutter 20 makes elastic contact with the lower surface of the horizontal bent part 24 of the outer cutter 18. A pin (not shown in the drawings) that is reciprocatingly driven by the motor of the shaver main body 10 engages a downwardly-opened groove 52 of the sliding plate 38 and reciprocates the inner cutter 20. Hair entered the slits 28 of the outer cutter 18 is cut by the reciprocating inner cutter 20.

In this shaver, all of the slits 28 of the outer cutter 18 open toward the open end 26 side of the horizontal bent part 24. Accordingly, when the shaver head 12 is moved down to the left in FIG. 6 (or in the direction of arrow O), that is, in the direction in which the slits 28 open, hair enters the slits 28 in good order and as a result is cut. However, when the head 12 is moved to the opposite side (or in the direction opposite to the direction O), then hair cannot be introduced into the slits 28 smoothly. The resulting problem is that unruly hair cannot be cut adequately.

A concept that is to solve this problem is to have the slits 28 open not only on the open end side but also on the bent corner 30 side that is the opposite from the open end 26 side. However, if the slits 28 open on both open and bent corner sides, then a problem arises that the comb-like portion remaining between the slits 28 loses its strength.

BRIEF SUMMARY OF THE INVENTION

The present invention is to solve the problems described above.

The object of the present invention is to provide a reciprocating type electric shaver that prevents failure to shave unruly hair due to the movement direction of the shaver head and prevents changes in the shaving feeling, that adequately shaves unruly hair with good efficiency, that improves the shaving feeling, and that ensures sufficient strength in the outer cutter.

The above object of the present invention is accomplished by a unique structure of the present invention for a reciprocating type electric shaver that includes a trimmer blade which is substantially reverse L-shaped and installed in a shaver head provided on a shaver main body; and in the present invention,

- the trimmer blade comprises a stationary outer cutter bent in substantially a reverse L shape in cross section and a movable inner cutter that makes sliding contact with the inner surface of the stationary outer cutter; and
- the stationary outer cutter has a horizontal bent part which is provided at the upper end thereof, and the horizontal bent part is formed with first slits that open toward an open end side of the horizontal bent part and second slits that open toward a bent corner side of the horizontal bent part, so that the stationary outer cutter works together with the movable inner cutter to cut hair (whiskers) that enters the first and second slits.

As seen from the above, in the shaver of the present invention, the horizontal bent part of the stationary outer cutter is formed with first slits that open toward the open end side and second slits that open toward the bent corner side that is on the opposite side from the open end side, so when the shaver head is moved, during shaving, to the open end side of the horizontal bent part, hair (whiskers) can enter the first slits smoothly and assuredly. Also, when the shaver head is moved to the bent corner side of the horizontal bent part, hair (whiskers) can enter the second slits smoothly and assuredly. As a result, hair (whiskers) that enters the first and second slits is cut by the reciprocating inner cutter. Also, since the first and second slits are formed so as not to transect the horizontal bent part of the stationary outer cutter in the width direction, the strength of the stationary outer cutter is ensured to be sufficiently large.

In the present invention, since the first and second slits respectively open on the open end and on the opposite bent corner of the horizontal bent part (24A) of the outer cutter, hair that is not only perfectly straight but also curved can enter the slits smoothly upon the movement of the shaver head into both the open end side and into the bent corner side; and both straight and curved or unruly hair is cut, so that hair can be shaved with good efficiency with an improved shaving feeling.

In the present invention, the first slits and the second slits are preferably alternatingly provided in the reciprocating or lengthwise direction of the movable inner cutter. This arrangement averages out changes in the shaving feeling due to the movement direction of the shaver head. However, the first slits and the second slits can be arranged so that, for instance, two or more first slits are provided consecutively and a single (or two or more) second slit is (are) provided between the two or more consecutive first slits, and vice versa. In short, in the present invention, the first slits and the second slits are provided adjacent to each other.

In the present invention, either the first slits or the second slits may open at both sides of the horizontal bent part (so that either the first slits or the second slits open on the open end side and on the bent corner side). For example, the first slits open only on the open end side, and the second slits open on both sides. The inner cutter used in combination with this outer cutter has a horizontal bent part at its top end and is formed with slits that transect this horizontal bent part in the width direction (the direction orthogonal to the reciprocating motion direction). In other words, the horizontal bent part are formed with slits that open toward the open end side and bent corner side.

With the above structure, hair entering from both the open end side and bent corner side of the outer cutter is cut smoothly by the slits of the reciprocating inner cutter. Same as the first and second slits of the outer cutter, the slits in the inner cutter can be separately provided as slits that open on the open end side and slits that open on the bent corner side.

The open end side of the horizontal bent part of the outer cutter can be bent slightly downward to conceal the tip end of the open end side of the inner cutter. With this structure, skin that touches the open end side of the horizontal bent part of the outer cutter is prevented from entering the inside of the outer cutter, and the skin will not touch the reciprocating inner cutter.

DETAILED DESCRIPTION OF THE INVENTION

Figure 1A:
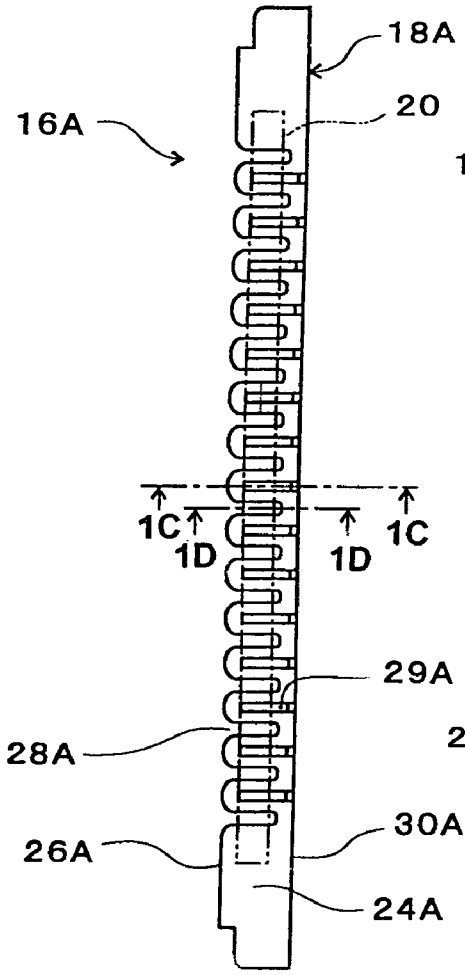
FIG. 1A is a top view of a trimmer blade of the shaver according to the present invention.
Figure 1B:
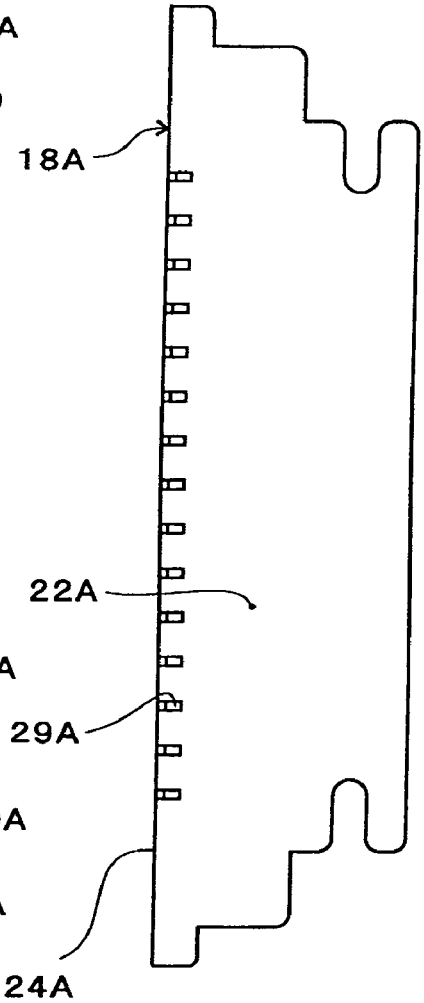
FIG. 1C is a cross-sectional view taken along the line 1C-1C in FIG. 1A.
FIG. 1D is a cross-sectional view taken along the line 1D-1D in FIG. 1A.

The trimmer blade 16A shown in FIG. 1A through 1D is used instead of the trimmer blade 16 in the conventional device shown in FIGS. 6-9; and portions that are the same as those of the trimmer blade 16 of FIGS. 6-9 are assigned the same reference numerals, and the different portions are assigned corresponding reference numerals with alphabets such as A, B, etc. added. In the following descriptions, mainly the different portions will be described, and explanations for the same and corresponding portions will not be repeated.

In the structure shown in FIGS. 1A through 1D, only the outer cutter 18A of the trimmer blade 16A differs from what is shown in FIGS. 6-9. In other words, in the outer cutter 18A, first slits 28A that open on the open end 26A side of the horizontal bent part 24A and second slits 29A that open on the bent corner 30A side, which is the opposite side from the open end 26A, are alternatingly disposed in the lengthwise direction of the stationary outer cutter or in the reciprocating direction of the movable inner cutter. The opening of each one of the first slits 28A has opening edges that widen in a circular arc shape on both sides as shown in FIG. 1A, and thus hair can enter easily.

Figure 1C:
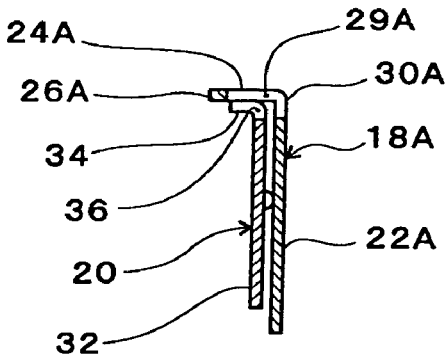
Figure 1D:
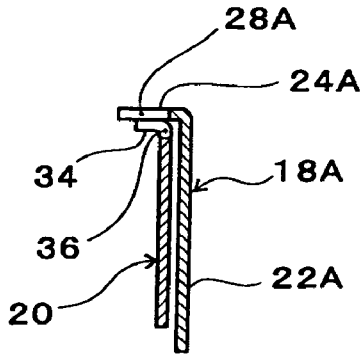
Figure 2A:
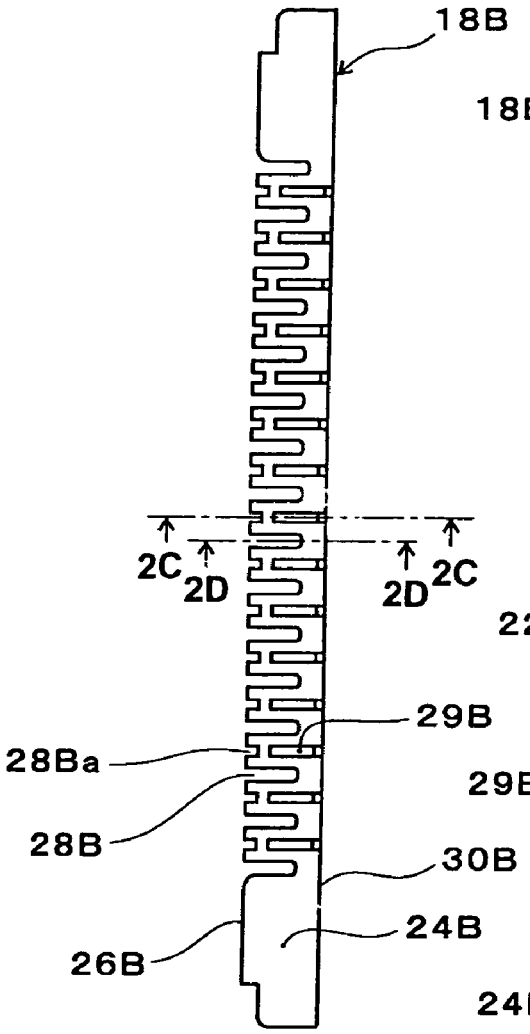
FIG. 2A is a top view of another trimmer blade of the shaver according to the present invention.
Figure 2B:
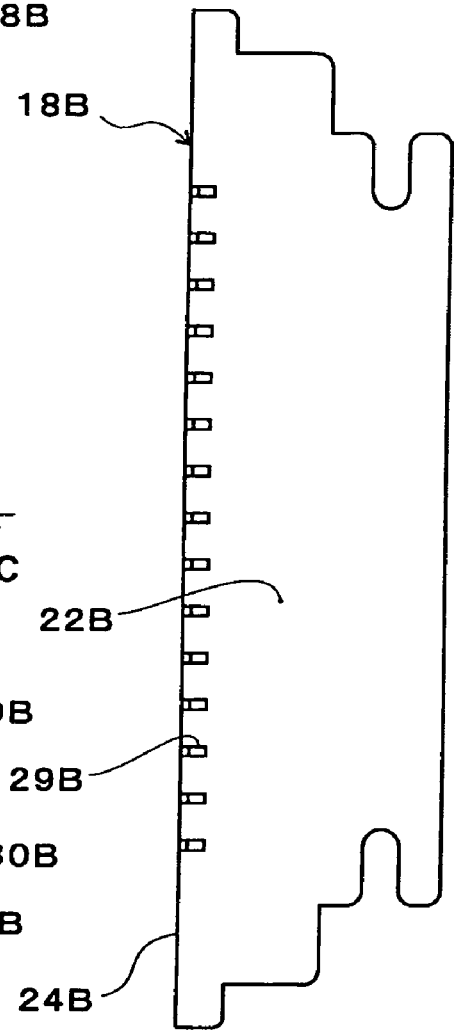
FIG. 2B is a right side view thereof.
Figure 2C:
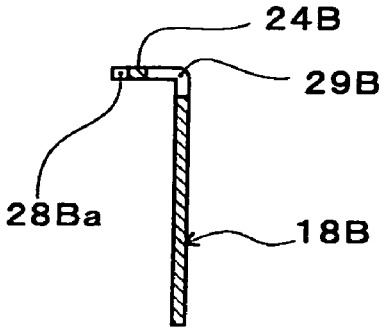
FIG. 2C is a cross-sectional view taken along the line 2C-2C in FIG. 2A.
Figure 2D:
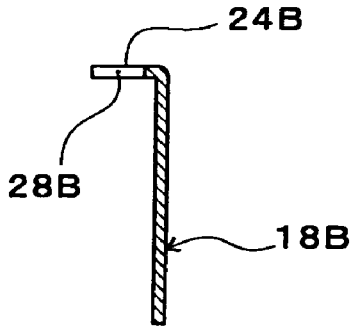
FIG. 2D is a cross-sectional view taken along the line 2D-2D in FIG. 2A.
Figure 8:
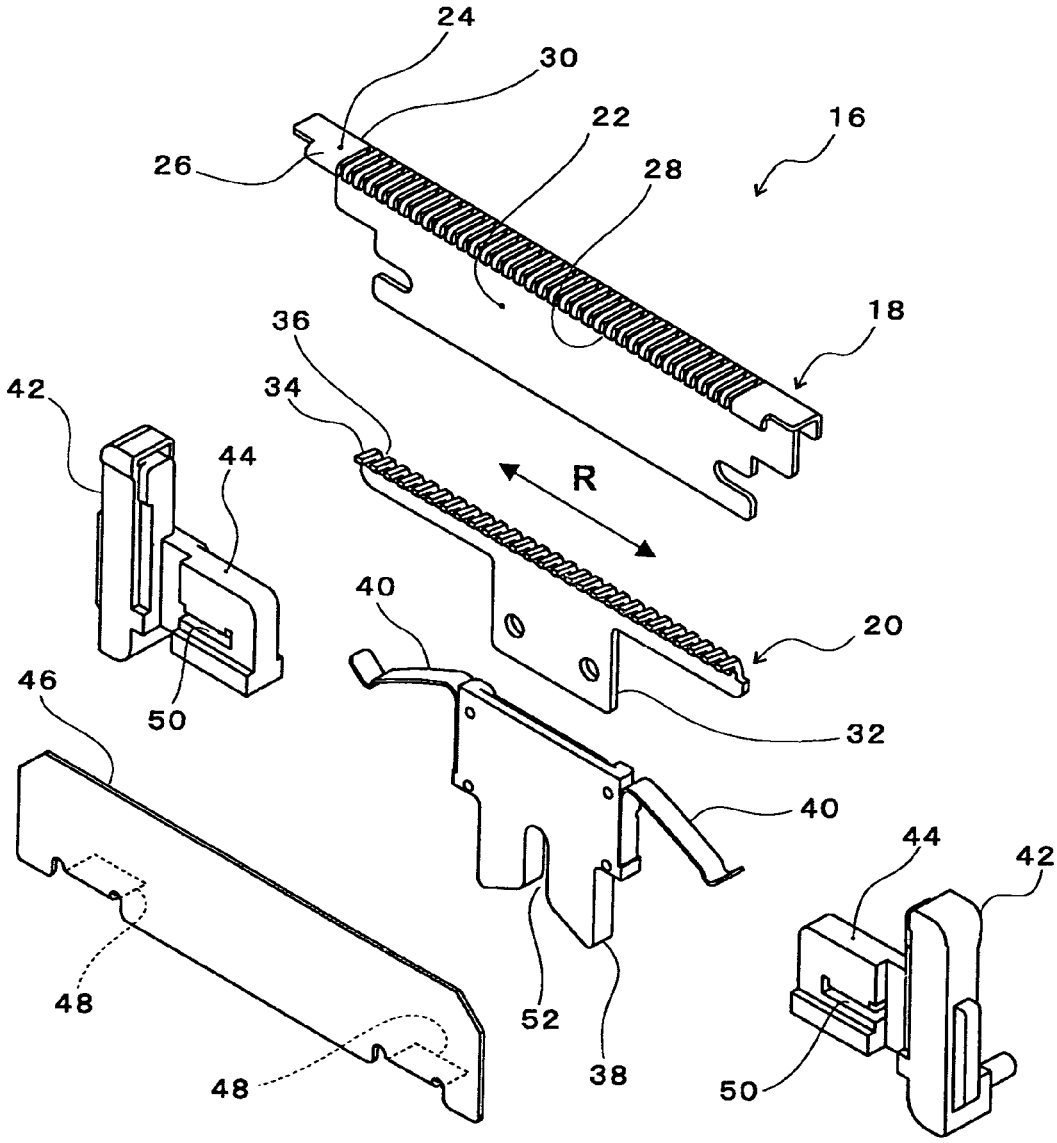
FIG. 8 PRIOR ART
FIG. 8 is a disassembled perspective view thereof.
Figure 9A:
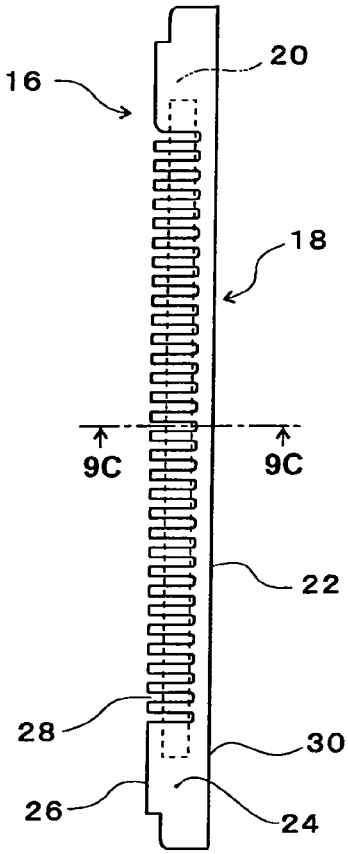
FIG. 9A PRIOR ART
FIG. 9A is a top view of the stationary outer cutter of the trimmer blade shown in FIG. 7, showing the shape of the slits.
Figure 9B:
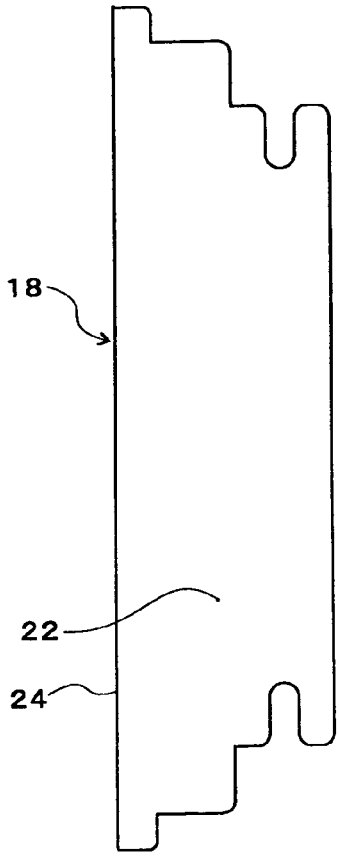
FIG. 9B PRIOR ART
FIG. 9B is a right side view thereof.
Figure 9C:
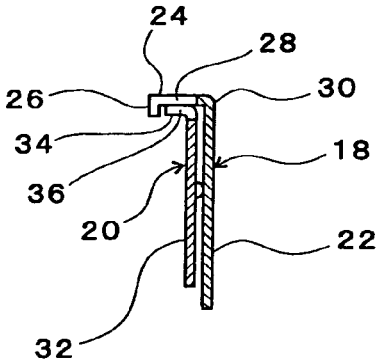
FIG. 9C PRIOR ART
FIG. 9C is a cross-sectional view taken along the line 9C-9C in FIG. 9A with the inner cutter installed underneath.

The inner cutter 20 is the same as the one shown in FIGS. 8 and 9, but the slits 36 provided on its horizontal bent part 34 is formed so as to transect the horizontal bent part 34 in the width direction as best seen from FIGS. 1C and 1D. Therefore, hair that enters the first slits 28A and the second slits 29A of the outer cutter 18A enters the slits 36 of the inner cutter 20 from both sides thereof and is cut smoothly.

FIGS. 2A through 2D show another trimmer blade 16B of the present invention. In this trimmer blade, the inner cutter is the same as that shown in FIGS. 1, 8, and 9 and thus not shown.

In the outer cutter 18B of the trimmer blade 16B shown in FIGS. 2A through 2D, first slits 28B that open toward the open end 26B of the horizontal bent part 24B and second slits 29B that open on the bent corner 30B side which is the opposite side from the open end 26B are alternatingly disposed in the lengthwise direction of the stationary outer cutter or in the reciprocating direction of the movable inner cutter. Furthermore, short slits 28B*a* are formed between the first slits 28B so as to open in the open end 26B.

In the structure of FIGS. 2A through 2D, since the first slits 28B and the short slits 28B*a* are formed to open on the open end 26B side, slanted and curved unruly hair can be more easily raised. Furthermore, unruly hair is made to stand up by the back and forth motion of the shaver head during shaving, and the thus raised unruly hair enters the first and second slits 28B and 29B of the outer cutter and is cut by the reciprocating inner cutter.

FIGS. 3A through 3D show a still another trimmer blade 16C of the present invention.

In the structure of FIGS. 3A through 3D, first slits 28C that open only on the open end 26C side of the horizontal bent part 24C of the outer cutter 18C of the trimmer blade 16C and second slits 29C that open toward both open end 26C side and bent corner 30C side are alternatingly disposed in the lengthwise direction of the stationary outer cutter or in the reciprocating direction of the movable inner cutter. In other words, as best seen from FIG. 3C, the second slits 29C transect the horizontal bent part 24C in the width direction and open on the open end 26C side and on the bent corner 30C side.

Figure 3A:
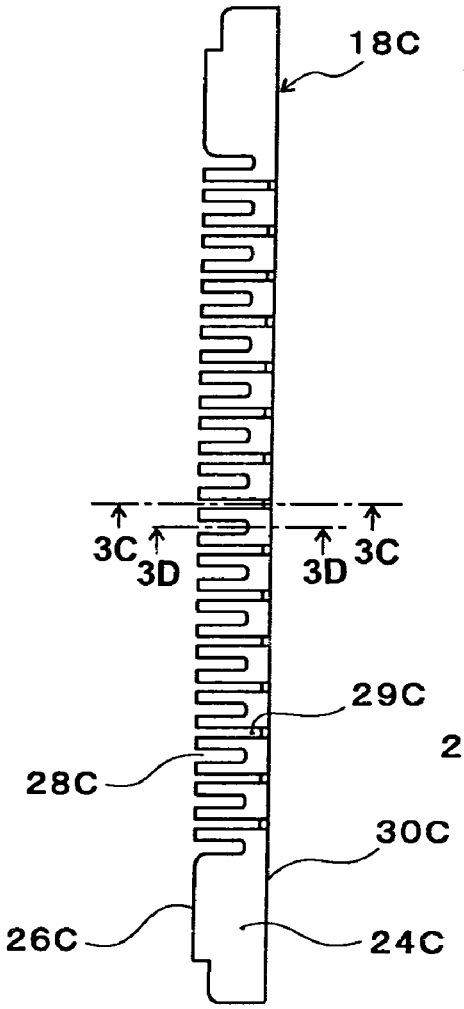
FIG. 3A is a top view of still another trimmer blade of the shaver according to the present invention.
Figure 3B:
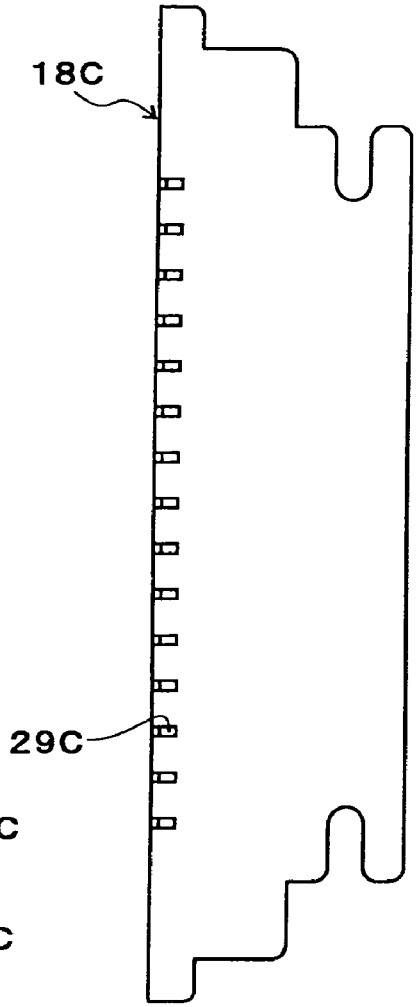
FIG. 3B is a right side view thereof.
Figure 3C:
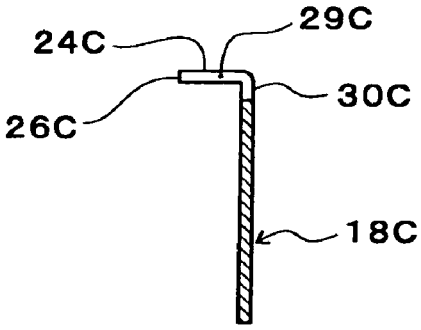
FIG. 3C is a cross-sectional view taken along the line 3C-3C in FIG. 3A.
Figure 3D:
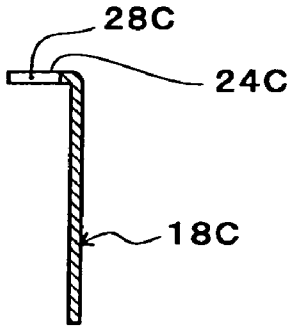
FIG. 3D is a cross-sectional view taken along the line 3D-3D in FIG. 3A.
Figure 4A:
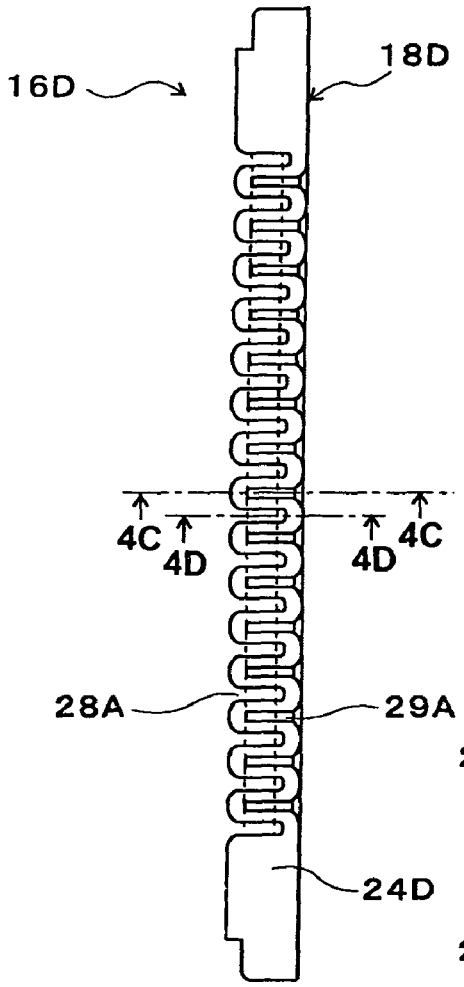
FIG. 4A is a top view of still another trimmer blade of the shaver according to the present invention.
Figure 4B:
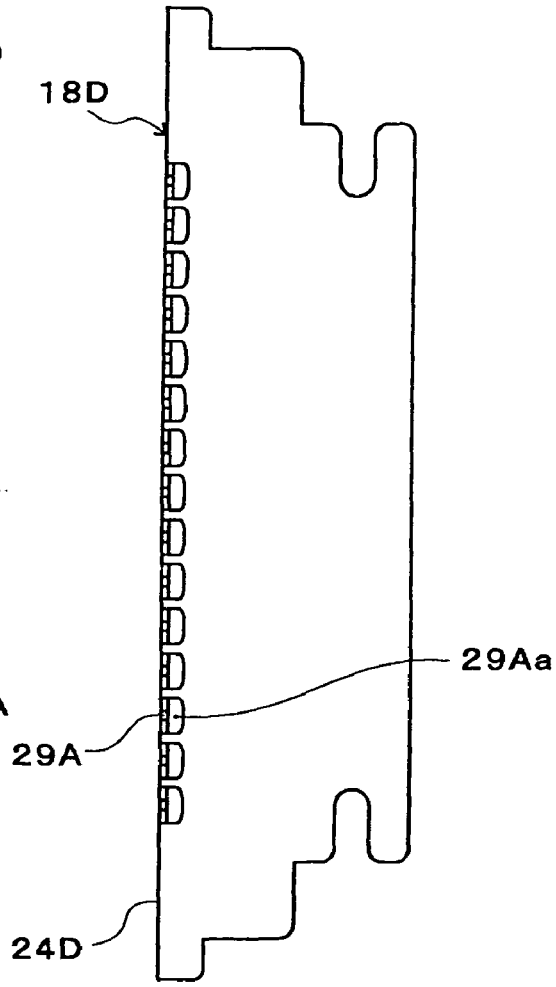
FIG. 4B is a right side view thereof.
Figure 4C:
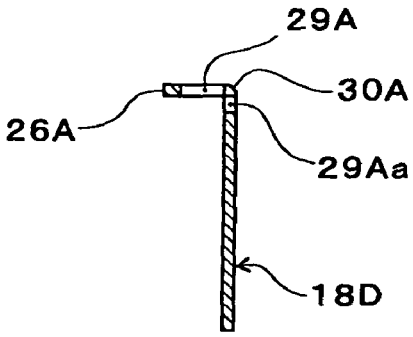
FIG. 4C is a cross-sectional view taken along the line 4C-4C in FIG. 4A.
Figure 4D:
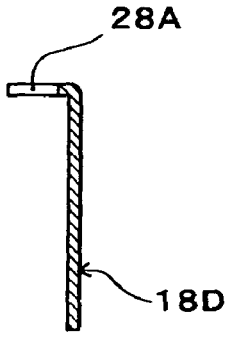
FIG. 4D is a cross-sectional view taken along the line 4D-4D in FIG. 4A.

With the arrangement of the first and second slits in FIGS. 3A through 3D, when the shaver and therefore the outer cutter 18C is moved to the left in FIG. 3A, hair enters the first and second slits 28C and 29C and is cut by the reciprocating inner cutter; on the other hand, when the shaver and therefore the outer cutter 18C is moved to the right in FIG. 3A, hair enters the second slits 29C and is cut by the reciprocating inner cutter. Therefore, if the spacing (pitch) of the slits 28C and 29C is made to be the same as that of the structures of FIGS. 1A and 2A, then the spacing of the slits 28C and 29C that open on the open end 26C side is one-half. Accordingly, when the outer cutter 18C is moved to the left in FIG. 3A, efficiency in cutting the hair greatly improves (theoretically about two times).

FIGS. 4A through 4D and FIG. 5 show still another trimmer blade 16D of the present invention. The outer cutter 18D of the trimmer blade 16D shown in FIGS. 4A through 4D resembles the one shown in FIGS. 1A through 1D, so the same reference numerals are assigned to the same parts and description thereof is not repeated.

Figure 5:
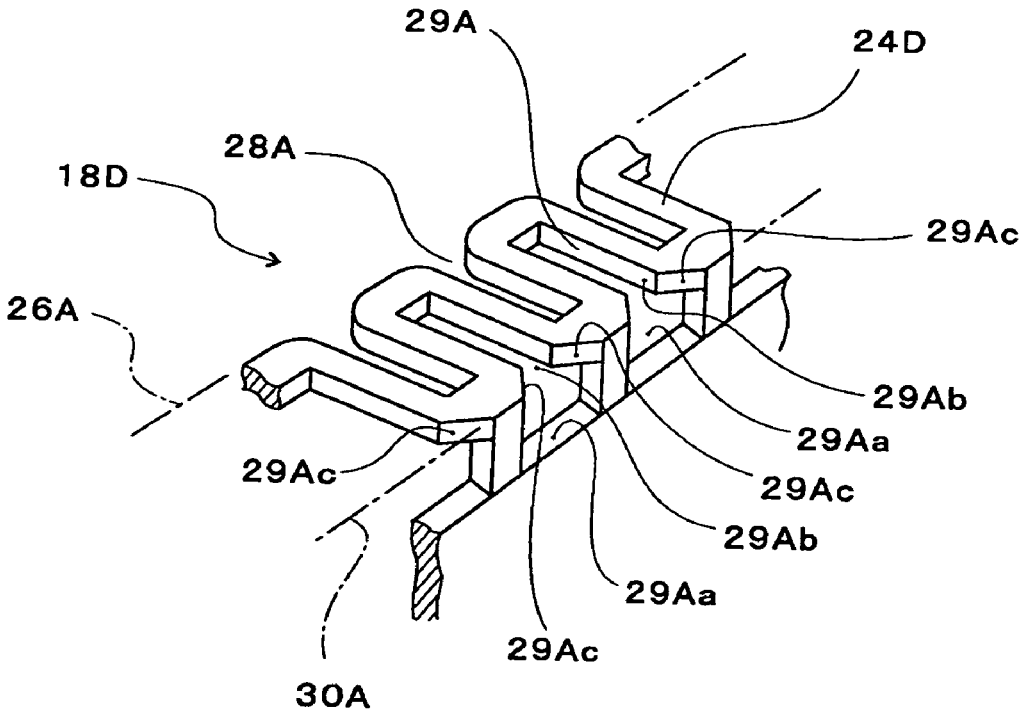
FIG. 5 is an enlarged perspective view of the outer cutter used in the trimmer blade shown in FIG. 4.
Figure 6:
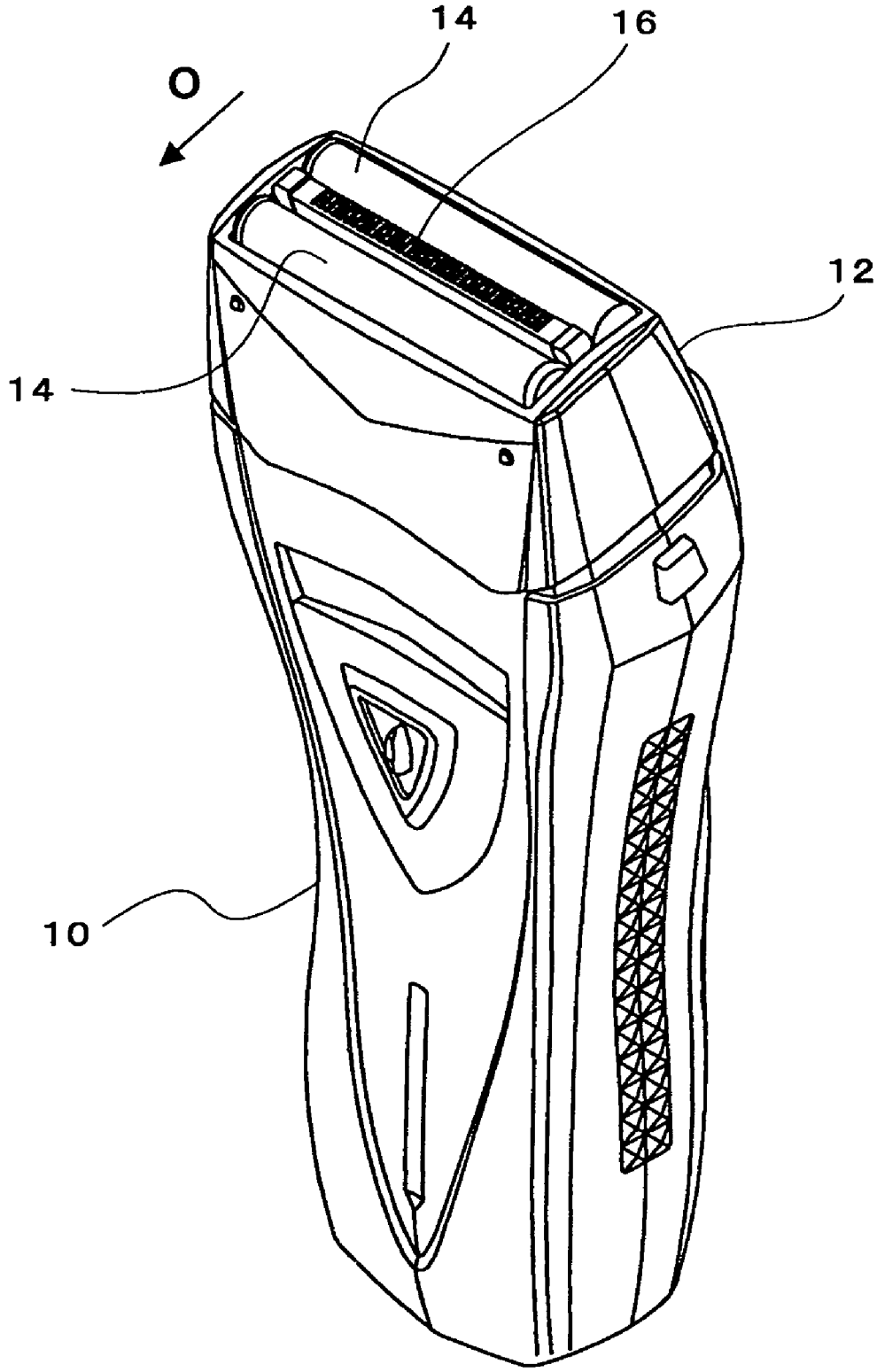
FIG. 6 PRIOR ART
FIG. 6 is an overall view of an existing electric shaver.
Figure 7:
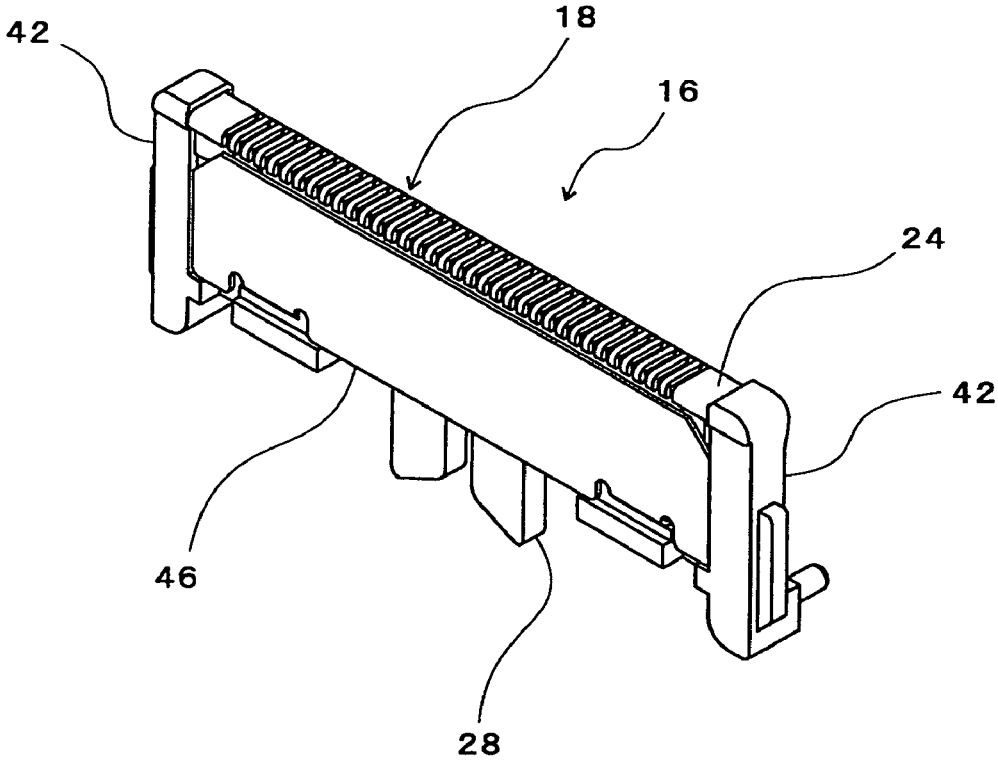
FIG. 7 PRIOR ART
FIG. 7 is a perspective view of the trimmer blade thereof.

The trimmer blade 16D shown in FIGS. 4A through 4D differs from the one shown in FIGS. 1A through 1D in that, as best seen from FIG. 5, windows 29A*a* are provided below the entrance of the second slits 29A, which open on the bent corner 30A side of the horizontal bent part 24A of the outer cutter 18D. In addition, the width of each one of the openings 29A*b* of the second slits 29A is widened so as to be continuous to the opening width of each window 29A*a*.

In this structure of the trimmer blade shown in FIGS. 4A through 4D and FIG. 5, the openings 29A*b* of the second slits 29A are formed continuous to the windows 29A*a*, and walls 29A*c* project on the upper side of the window 29A*a*. Accordingly, when the shaver and therefore the trimmer blade 16D is moved to the right side in FIG. 4A, unruly hair is guided by the walls 29A*c* and enters the windows 29A*a*, and also the bases of the hair enter the second slits 29A. In other words, the walls 29A*c* raise unruly hair while smoothly guiding them into the second slits 29A. As a result, unruly hair is shaved with good efficiency when the trimmer blade 16D is moved to the right side in FIG. 4A as well.

In the structures described above, the first slit and the second slit are provided alternatingly. However, the first slits and the second slits can be arranged so that, for instance, two or more first slits are provided consecutively and a single (or two or more) second slit is (are) provided between the two or more consecutive first slits; or two or more second slits are provided consecutively and a single (or two or more) first slit is (are) provided between the two or more consecutive second slits.

The invention claimed is:

1. A reciprocating type electric shaver consisting of:

a trimmer blade installed adjacent to a finishing blade in a shaver head provided on a shaver main body, and said trimmer blade consists of a stationary outer cutter bent in substantially a reverse L shape in cross section and a movable inner cutter bent in substantially reverse L shape in cross-section that makes sliding contact with the inner surface of the stationary outer cutter; and wherein said inner cutter has slits formed therein;

said stationary outer cutter has a substantially flat horizontal bent part which is provided at an upper end thereof, and said horizontal bent part is formed with first slits that open toward an open end side of said horizontal bent part and second slits that open toward a bent corner side of said horizontal bent part with said first and second slits extending transversely to a reciprocating direction of said inner cutter;

a horizontal bend part of said movable inner cutter is shorter in length than the horizontal bent part of the stationary outer cutter;

said first and second slits of said stationary outer cutter work together with said slits of said movable inner cutter to cut hair that enters said first and second slits from both said open end side and said bent corner side; and said second slits are wider than said first slits.

2. The reciprocating type electric shaver according to claim 1, wherein said first slits and said second slits formed in said horizontal bent part of said stationary outer cutter are alternatingly disposed in a reciprocating direction of said movable inner cutter.

3. The reciprocating type electric shaver according to claim 1, wherein said slits of said movable inner cutter are formed toward said open end side and bent corner side of said horizontal bent part of said stationary outer cutter.

4. The reciprocating type electric shaver according to claim 1, wherein said stationary outer cutter is made from a single piece of material.

* * * * *